US005342415A

United States Patent [19]

Wasinger et al.

[11] Patent Number: 5,342,415

[45] Date of Patent: * Aug. 30, 1994

[54] OZONE DECOLORIZATION OF GARMENTS

[75] Inventors: Eric Wasinger, 551 Boyd St., Wichita, Kans. 67212; David Hall, Auburn, Ala. 36830

[73] Assignee: Eric Wasinger, Wichita, Kans.

[ * ] Notice: The portion of the term of this patent subsequent to Jun. 2, 2009 has been disclaimed.

[21] Appl. No.: 776,609

[22] Filed: Oct. 10, 1991

Related U.S. Application Data

[62] Division of Ser. No. 560,357, Jul. 31, 1990, Pat. No. 5,118,322.

[51] Int. Cl.[5] ..... D06L 3/14; D06L 3/04

[52] U.S. Cl. ..... 8/111; 8/101; 8/102

[58] Field of Search ..... 8/101, 110, 111, 114.6, 8/447, 478, 472, 483, 482, 102

[56] References Cited

U.S. PATENT DOCUMENTS

| | | | |
|---|---|---|---|
| 1,760,042 | 5/1930 | Crespi et al. | 8/111 |
| 4,214,330 | 7/1980 | Thorsen | 8/149.2 |
| 5,006,124 | 4/1991 | Tieckelmann et al. | 8/111 |
| 5,019,131 | 5/1991 | Nitsch, Jr. | 8/457 |
| 5,118,322 | 6/1992 | Wasinger et al. | 8/111 |

FOREIGN PATENT DOCUMENTS

| | | |
|---|---|---|
| 0593933 | 9/1925 | France . |
| 646690 | 11/1950 | United Kingdom . |

OTHER PUBLICATIONS

Chem Abst. 89:164841p, 1978 Dymova, Z. N. et al. Mater-Uses Mezhuuz. Konf Ozonu 2d Gos. Univ: Moscow USSR, 1977.

*Primary Examiner*—Margaret Medley
*Attorney, Agent, or Firm*—John Lezdey

[57] ABSTRACT

A process for selectively decolorizing a garment containing cellulosic material which comprises the steps of providing said garment with a dye or coloring agent reactive to ozone, wetting said garment and then contacting said wetted garment with ozone or a mixture of steam and ozone whereby the ozone is reacted with the dye or coloring agent.

2 Claims, 1 Drawing Sheet

OZONE DECOLORIZATION OF GARMENTS

This is a division application of Ser. No. 560,357, filed Jul. 31, 1990 now U.S. Pat. No. 5,118, .

FIELD OF THE INVENTION

The present invention relates to the fading or decolorization of dyes or coloring agents on garments. More particularly, the invention is concerned with the decolorization and/or fading of dyed garments containing cellulosic materials through the use of ozone without any substantial deterioration of the garment. The invention is particularly useful in preparing fashion garments such as faded denim blue jeans, and the like, without the use of harsh chemical bleaches on the abrasive effects of stones, pumice, sand or the like.

BACKGROUND OF THE INVENTION

Denim blue jeans which have been faded, "stone-washed", ice washed, or sand blasted to produce a particular appearance are very popular. However, to produce the desired effect it has been necessary to utilize processes which cause substantial deterioration or degradation of the fabric. Bleaching solutions containing chlorine or actual pelleting of the garment with sand or stones to produce a fashion effect causes damage to the fabric which affects its wear life.

Ozone has been used in the bleaching of cellulosic materials. U.S. Pat. No. 4,283,251 to Singh discloses the bleaching of cellulosic pulp with gaseous ozone in an acidic pH followed by an alkaline treatment.

U.S. Pat. Nos. 4,214,330 and 4,300,367 to Thorsen, which are herewith incorporated by reference, describe a method and an apparatus for treatment of undyed fabrics with a ozone-steam mixture. The process is used to shrinkproof the fabric with a minimum amount of deterioration of the fabric fibers. The ozone treatment reacts with the undyed fibers and provides whiter fibers. The treatment is stated to increase subsequent dyeability and dye fastness of the garment.

W. J. Thorsen et al in their paper entitled, "Vapor-Phase Ozone Treatment of Wool Garments", *Textile Research Journal*, Textile Research Institute, 1979, p. 190–197, describe the treatment of wool fabrics and garments with ozone and steam to provide shrink resistance to the fabric or garment. The process is based on the reaction of the ozone with the wool fibers.

It should be understood that the term "dye" as used herein is meant to include any of the materials which are used to provide a color to a fabric such as conventional dyes, pigments, or the like.

It should be understood that the term "ozone and steam" as used herein denotes a preferable method of the invention and is meant to include ozone alone or ozone diluted with inert gases.

SUMMARY OF THE INVENTION

In accordance with the invention there is provided a process for selectively decolorizing a garment containing cellulosic material which in its simplest form comprises the steps of 1) providing the garment containing a dye which is reactive to ozone, 2) wetting said garment, and then, 3) contacting the wetted garment with ozone or a mixture of ozone and steam so as to cause a reaction of the ozone with the dye. The garment may comprise cotton, linen, or other bast fibers or rayon alone or in combination with other materials including natural and synthetic fibers.

Preferably, the dyed garment is decolorized or faded without bleaching the fabric and causing degradation of the fabric.

The ozone primarily reacts with the dye of the garment when the garment is wet. Therefore, the garment is wetted or treated in a wet state. The water content of the wetted garment is preferably about 20 to 40% by weight or higher depending upon the degree of treatment and the effect desired. The process may either be batchwise or continuous and is performed in a chamber in which the ozone is generally present in an amount of about 10 to 100 mg. per liter. The ozone and the steam are injected into the chamber so as to provide a temperature in the chamber of about 40° to 100° C., preferably 50° to 65° C. In the absence of steam, heating elements in the chamber can be used to maintain the temperature. Any excess ozone emitted may be recycled back into the chamber or used to treat any effluent of the process.

In accordance with a preferred embodiment of the invention, one or more ozone reactive dyed wet garments which have been treated with an ozone blocking agent or dyes of different ozone reactivity or sensitivity are placed in an enclosed chamber. A spectrophotometer in association with a computer continuously senses the garment and the reaction of ozone with the dye by means of the color change of the dyed garments. Steam is emitted into the chamber until the temperature is between about 40° and 100° C. When the desired temperature is reached, ozone is emitted into the chamber so as to mix with the steam and react with the dye of the garments. The concentration of the ozone in the chamber is maintained between 10 to 100 mg per liter by monitoring with an ozone photometer. When the garments reach a predetermined color, that is, the dye undergone a decolorizing has reaction with the ozone whereby the desired color is obtained, the reaction is terminated prior to any substantial reaction of the ozone with the fabric of the garment.

It is a general object of the invention to fade or decolorize dyed garments.

It is a further object of the invention to decolorize dyed garments with ozone without bleaching the fabric.

It is yet still further object of the invention to selectively and/or evenly decolorize or fade dyed garments to produce fashion garments.

It is another object of the invention to provide garments with different degrees of color by use of dyes or varying ozone sensitivity and/or to provide different levels of colorization throughout the garment.

It is yet another object of the invention to provide a process for decolorizing dyed garments while sensing the degree of color loss so as to avoid fabric degradation.

Other objects and a fuller understanding of the invention will be had by referring to the following description and claims of a preferred embodiment, taken in conjunction with the accompanying drawings.

DESCRIPTION OF THE PREFERRED EMBODIMENTS

Figure 1:
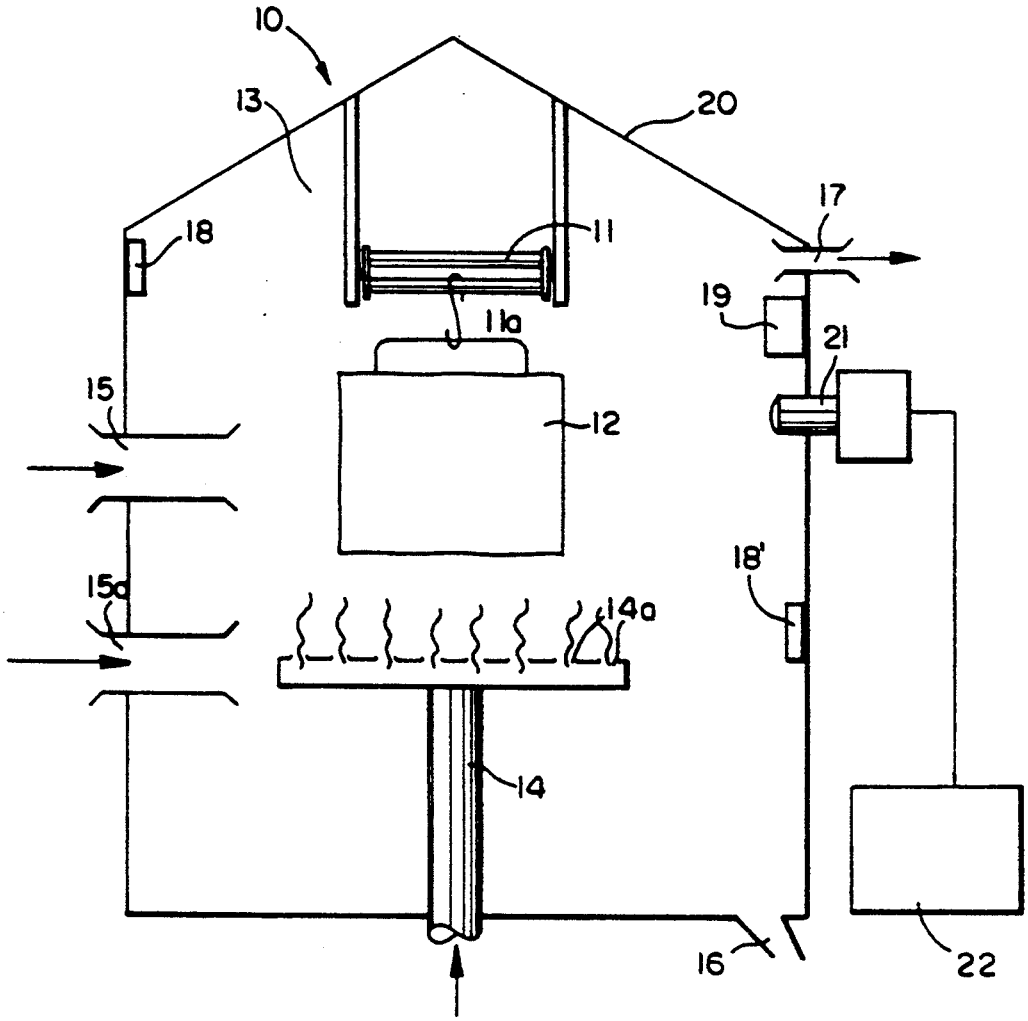
FIG. 1 is a schematic view of one form of an ozone treatment apparatus of the invention, and, FIG. 2 is a schematic view of the process of the invention.

Although specific terms are used in the following description for the sake of clarity, these terms are intended to refer only to the particular structure of the invention selected for illustration in the drawings and are not intended to define or limit the scope of the invention.

In accordance with a simple form of the invention there is provided an enclosed apparatus 10 having an internal chamber 13. The apparatus 10 is provided with an ozone inlet 15 which is associated with an ozone generator (not shown) and a steam delivery means 14 with orifices 14*a*. Preferably, the apparatus has a sloping roof 20 so that condensation from the steam will form on the walls and be carried to the drain 16 without dripping on the garments 12 in the chamber 13.

A wetted garment 12 is carried into the chamber 13 by means of hook or rack means 11*a* suspended from a conveyor 11. The chamber may be initially purged with an inert gas from inlet 15*a* prior to admission of the ozone through inlet 15. The garment 12 would generally be wet before it is treated with ozone since it is usually treated with the ozone after laundering but before drying. However, if the garment has not been prelaundered, then it is necessary to prewet the garment before beginning with the ozone treatment.

Where the garment is to be selectively faded, it may be treated with an ozone blocking agent prior to or subsequent to wetting. If the blocking agent is a hydrophobic material such as a hydrocarbon grease or wax, there is no noticeable loss of blocking agent when wetted. However, an inorganic blocking agent, such as a clay can be added after wetting.

Once in the chamber 13, the garment 12 is subjected to steam which is emitted from a steam pipe 14 with openings 14*a*. Ozone is passed into the chamber 13 through inlet 15. The chamber may first be purged with an inert gas or ozone, if desired, depending on the type or degree of decolorization desired. The amount of ozone present in the chamber 13 is monitored by an ozone photometer 19, such as Dasibi Model 1003 HC ozone photometer. The temperature within the chamber 13 is monitored by thermocouples 18, 18'. During the decolorization process, a spectrophotometer such as a Bausch and Lomb Colorscan Spectrophotometer, constantly senses the color of the garment 13. The sensing is preferably coordinated with a computer means 22 which records the color change and inactivates the process when the desired amount of color has disappeared from the dyed garment 12. The process may be inactivated by stopping the flow of ozone and removing the ozone through exit 17, or by removing the garment from the ozone atmosphere as in a continuous process.

A drain 16 is provided at the bottom of the chamber 13 to collect and remove the steam condensate.

The dimensions of the chamber 13 are not critical except that the middle section of the chamber 13 should be sufficiently sealed or elevated so as to confine the main concentration of the ozone and steam to the area where the garment 12 is hanging. The chamber 13 may be fabricated by any airtight material which is unreactive with ozone such as stainless steel, aluminum, teflon, polyolefin, and the like.

The central introduction of the ozone allows the reactive ozone, which may be admixed with other gases such as argon, nitrogen, etc., to react with the dye as the garment 12 and chamber 13 are being heated by the hot steam. Fans (not shown) may be provided to circulate the steam and ozone throughout the chamber 13.

The proportion of steam mixed with the ozone is adjusted so as to attain the desired gas temperature. Thus, by increasing the proportion of steam coming from a steam generator (not shown) through the steam pipe 14, the temperature within the chamber is increased. Otherwise, heating elements (not shown) within the chamber can be used. The temperature within the chamber is generally about 40° C. to 100° C., preferably, about 50° to 65° C.

The apparatus used in performing the process of the invention can comprise an open-ended chamber or a closed-end chamber. In a continuous process an open-ended chamber is preferred which comprises a plurality of chambers. The temperature of the ozone treatment chamber is preferably controlled by the temperature of the steam which is admixed with the ozone. Thermocouples 18, 18' may be used to measure the chamber temperature.

A spectrophotometer is preferably used to sense and determine the degree of color loss on the garment desired. The spectrophotometer is helpful in preventing fabric degradation by detecting the amount of dye available for reaction with the ozone. Advantageously, the spectrophotometer is linked with a computer for reading color values and controlling this process.

The type of dye used on the garment is not critical. It is only important that the dye is ozone reactive where intended. Cellulose substantive dyes, such as vat dyes, which are common in the garment industry, are preferably used. Exemplary of the dyes which are substantive to cellulose that can be used include Acid Light Scarlet GL, an acid leveling dye, Sevron Brilliant Red 2B, indigo vat dye, a cationic dye, Sulfonine Brilliant Red B, an anionic dye, Brilliant Milling Red B, C.I. Disperse Blue, pyrazolone azomethine dye, hydroxy azo dyes, or the like. Where the dye is a xanthene dye, treatment also gives rise to chemiluminescence in the process. Other suitable dyes that can be used are identified in the paper of Charles D. Sweeney entitled, "Identifying a Dye can be Simple or it Can Involve Hours of Laboratory Analysis", Textile Chemist and Colorist, Vol. 12, No. 1, Jan. 1980, pp 26/11.

The garments may be treated with one or more dyes. Utilizing dyes of differing degrees of ozone reactivities provides the garment with zones of different appearances or effects. For example, faded, stone washed, ice-washed, sand blasted or mottled effects may be obtained. The same effect can be achieved by utilizing ozone blocking agents. The ozone blocking agents may comprise organic materials such as hydrocarbon oils, greases or waxes or inorganic materials such as clay. Masking tape, or other coverings may be used. A further alternative method to achieve a special effect is to partially or selectively wet the garment since the ozone-dye reaction effectively takes place where the garment is wet. The ozone generally does not react with the fabric where it is not wet.

The blocking agent can also be any chemical agent which itself is reactive with ozone but prevents or blocks a dye or portion of a dye on the fabric from becoming decolorized.

It is understood that the reaction period and amount of ozone utilized is dependent upon different factors. That is, the time and amount of ozone depends upon the effect desired, the type of dye utilized, the temperature, degree of wetness, etc. Longer treatment at lower concentrations of ozone can result in the same effect as a short treatment with a large excess of ozone on the same dyes. Therefore, the sensing of the conditions in the reaction chamber is essential to optimize the present process.

The ozone within the chamber is preferably measured periodically and kept at a minimal and within the range of about 10 to 100 mg per liter. The ozone can be generated by on ozone generator of the type available from Griffin Technics, Inc., Model GTC-2B which produces ozone from dry air or oxygen using electrical circuit breakers or Corona discharge. The ozone may be used alone or diluted with inert gases.

Figure 2:
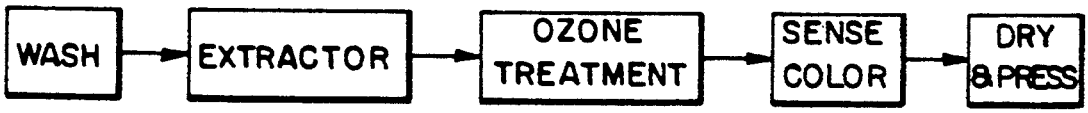

As shown schematically in FIG. 2, a garment to be faded, such as denim blue jeans, is generally first laundered to remove any sizing or fashion process coatings or materials which may interfere with the process of the invention. For example starch can act as an ozone blocking agent. The washing operation could include desizing using enzymes, as is common in the industry followed by laundering to cleanse the garment. The garment is then hydroextracted or padded dry so as to remove excess water. The water content of the garment should be about 20–40% by weight. If the garment is not wet, then it can be wetted by water spraying or the like.

The garment is treated with a blocking agent which is determined on the effect desired. For example, if a sand blasted or stone washed effect is desired, the wet garment can be sprayed with clay or some other inorganic powder to act as an ozone blocker. However, if a mottled look is desired, the garment may be treated with a suitable hydrocarbon oil, grease or wax which shields parts of the garment from the effects of ozone in a selected manner. The garment can be printed, the color can be applied by painting or using a mordant.

In lieu of the ozone blocking, special effects can also be achieved by selectively treating the garment with dyes having different degrees of ozone reactivity. The different dyes can be added earlier in the process so that the use of ozone blocking agents becomes optional. The non-reactive or lesser ozone reactive dyes may be applied by spraying, brushing, dipping, or the like. The non-reactive dyes include the pigment colors.

The wet garment is then conveyed into a closed ozone treatment chamber where its decolorization process is constantly sensed by a spectrophotometer, which is associated with an indicator such as a computer. The computer may be further associated with the controls for the ozone and the purge gas so as to stop the reaction as soon as the desired color or degree of dye reaction has been obtained.

The garment if treated with an ozone blocking agent may require the garment to be post washed to remove the blocking agent prior to other processing or treatment such as drying and pressing.

The present process has been found to eliminate the yellowing which occurs as a result of ice-washing blue denims.

The following example is illustrative of the invention, but is not to be construed as to limiting the scope thereof in any manner. The percentages herein disclosed relate to percent by weight.

EXAMPLE 1

A pair of cotton denim blue jeans vat dyed with a blue indigo dye (CI Vat Blue 1) was washed with a standard laundry detergent at 120° F. in a conventional washer which included a spin extractor. The garment after extraction had a moisture content of about 35% by weight. The garment was sprayed with clay to achieve a stone washed effect.

The garment was then hung in a closed chamber of the type seen in FIG. 1 of the drawing. The chamber was purged with nitrogen and steam heat was emitted into the chamber. When the chamber reached a temperature of about 52° C., ozone was emitted into the chamber until an ozone concentration of about 40 mg/l was obtained. After a residence time of 30 minutes, the ozone emission was stopped and the chamber was purged free of ozone.

Alternatively, the residence time may be determined by the use of a test fabric and programming a computer in association with a spectrophotometer to indicate when the desired color is achieved. Such sensing is preferred in a continuous process.

The garment was washed again in a commercial washer with a standard laundry detergent to remove the clay. The resulting garment had a stone washed effect and when examined with a scanning electron microscope did not reveal any signs of fiber degradation.

EXAMPLE 2

Grab Break tests were determined using ASTM Test Method D-1682 five breaks both warp and filling were made for each sample and averaged. Abrasion tests were determined according to ASTM Method D-3885 (stoll flex). Five samples both warp and filling were run and averaged. The fabrics were standard Levi style 501 garments.

Results

The overall results were given in Table 1. A standard ice wash procedure was used as the control.

A. Comparison of Ozone Treated Garments to Chlorine Treated Garments

The results for chlorine (Sodium Hypochloride) treatments are shown in Table 1. The treatment was done at normal (C1) medium (C2) and high (C3) chlorine contents in order to obtain increasing levels of color removal ranging from a medium blue to white. These treatments were matched to various ozone treatment times needed to achieve the same level of color removal. For example, C1 matched the ozone treatment for 1 hour while C2 matched the ozone treatment for 1.5 hours. No ozone treatment matched the C3 (totally white) jeans which is included for completeness. From the results it is observed that the ozone treated fabrics do not loose as much warp strength as the chlorine bleached garments. It is the warp yarns which contain the indigo dye. Filling yarns in denim are undyed hence the yarns were not protected from the full effects of the ozone. The test demonstrated that ozone treatments retain more of the abrasion resistance of the garments in both the warp and filling directions compared to chlorine bleach treatments.

B. Ozone Treatments

Fabrics were treated with ozone for 0.5 to 2.0 hours. The test results are given in Table 1. The fabric color became lighter with increasing time of ozone treatment. The color (dye) level in the garments was monitored by a Bausch and Lomb Color Scan Spectrophotometer.

C. Ozone Treatment of an Ice Washed Garment

An ice washed garment (control) was treated for 15 minutes in an ozone atmosphere (sample 03 ¼ hr.). Some loss in strength resulted, however, considerable abrasion resistance was restored as shown in Table 1. Also, the blue shade of the unbleached portion of the ice washed fabric could be further reduced in color to give a shading affect that cannot be achieved by the original ice washing technique. Further, ice washing produces a yellow color (staining) in the white (bleached) regions of the garment which reduces the garment attractiveness. This yellow colore (dye) is due to breakdown fragments (compounds) of the indigo dye which remain in the fabric to discolor the white background. The ozone treatment was effective in decolorizing these yellow compounds and gave a superior "white" background to the garments. That is, the ozone treatment corrected a major defect of ice wash treatments.

TABLE 1

Comparison of Strength (Grab Break and Abrasion) for Various Fabric Treatments

| Treatment | Test Results Grab Break (lbs.) Warp | Grab Break (lbs.) Fill | Abrasion (Cycles) Warp | Abrasion (Cycles) Fill |
|---|---|---|---|---|
| Part C | | | | |
| Ice Washed (control) | 174 | 150 | 5473 | 3979 |
| Part B | | | | |
| Ozone (03) 0.25 Hrs. | 139 | 120 | 9014 | 5784 |

TABLE 1-continued

Comparison of Strength (Grab Break and Abrasion) for Various Fabric Treatments

| Treatment | Test Results Grab Break (lbs.) Warp | Grab Break (lbs.) Fill | Abrasion (Cycles) Warp | Abrasion (Cycles) Fill |
|---|---|---|---|---|
| 0.50 Hrs. | 224 | 120 | 9527 | 5955 |
| 1.0 Hrs. | 245 | 105 | 20428 | 11665 |
| 1.5 Hrs. | 195 | 141 | 8906 | 4894 |
| 2.0 Hrs. | 174 | 110 | 5588 | 4278 |
| Part A Chlorine | | | | |
| (C1) Medium Blue | 225 | 134 | 14080 | 7524 |
| (C2) Light Blue | 179 | 101 | 5823 | 4350 |
| (C3) White | 143 | 81 | 3266 | 2920 |

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A method for decolorizing an ice washed dyed cellulosic garment having an undesirable oxidizable coloring agent obtained by prior treatment with potassium permanganate which comprises the steps of contacting said garment in the presence of moisture and ozone in a vapor phase in a chamber at a temperature of about 40° to 100° C. for a period of time to decolorize said coloring agent and terminating contact with ozone prior to any degradation of said garment or the dye on the garment.

2. The method of claim 1 wherein said ozone is present in an amounts of about 10 to 100 mg per liter.

* * * * *